US009511586B2

(12) United States Patent
Iijima

(10) Patent No.: US 9,511,586 B2
(45) Date of Patent: Dec. 6, 2016

(54) INK JET HEAD AND PRINTER

(71) Applicants: KABUSHIKI KAISHA TOSHIBA, Tokyo (JP); TOSHIBA TEC KABUSHIKI KAISHA, Tokyo (JP)

(72) Inventor: Tomomi Iijima, Mishima Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/851,339

(22) Filed: Sep. 11, 2015

(65) Prior Publication Data

US 2016/0082729 A1 Mar. 24, 2016

(30) Foreign Application Priority Data

Sep. 19, 2014 (JP) ..... 2014-191242

(51) Int. Cl.
*B41J 2/14* (2006.01)
*B41J 2/155* (2006.01)
*B41J 2/21* (2006.01)

(52) U.S. Cl.
CPC ..... *B41J 2/1433* (2013.01); *B41J 2/14201* (2013.01); *B41J 2/155* (2013.01); *B41J 2/2146* (2013.01); *B41J 2002/14419* (2013.01); *B41J 2002/14491* (2013.01); *B41J 2202/19* (2013.01); *B41J 2202/20* (2013.01)

(58) Field of Classification Search
CPC ..... B41J 2/1433; B41J 2/14201; B41J 2/14; B41J 2/155
See application file for complete search history.

(56) References Cited

U.S. PATENT DOCUMENTS 7,040,737 B2 * 5/2006 Takata ..... B41J 2/14209 347/20
2012/0147096 A1 6/2012 Yamamoto
2015/0224764 A1 * 8/2015 Iijima ..... H05K 7/20436 347/17
2015/0328883 A1 * 11/2015 Iijima ..... B41J 2/14233 347/9

FOREIGN PATENT DOCUMENTS

JP 2012-125936 A 7/2012

OTHER PUBLICATIONS

Tomomi Iijima, U.S. Appl. No. 14/713,576, filed May 15, 2015.

* cited by examiner

*Primary Examiner* — Sarah Al Hashimi
(74) *Attorney, Agent, or Firm* — Patterson & Sheridan, LLP

(57) ABSTRACT

An ink jet head includes a head body, a plurality of pipes, a plurality of flexible substrates, a reference plate, a plate base, a plurality of in-covers, and a plurality of side covers. Each of the in-covers includes an inner surface having a first mating surface in contact with the plate base, and an outer surface having a second mating surface in contact with the driving circuits. Each of the side covers includes an inner surface that is thermally coupled to a respective one of the plurality of in-covers and has a third mating surface in contact with the second mating surface section of the respective one of the plurality of in-covers, and an outer surface fastened to the print wiring substrate.

20 Claims, 10 Drawing Sheets

INK JET HEAD AND PRINTER

CROSS-REFERENCE TO RELATED APPLICATION

This application is based upon and claims the benefit of priority from Japanese Patent Application No. 2014-191242, filed Sep. 19, 2014, the entire contents of which are incorporated herein by reference.

FIELD

Embodiments described herein relate generally to an ink jet head and a printer.

BACKGROUND

A printer body (ink jet printer body) is provided with an ink jet head and ejects ink droplets by pressurizing ink. In the related art, the ink jet head is provided with a driver integrated circuit (IC) for driving ejection, and a cover is provided on an outside of the driver IC, the cover being adapted to release heat from the driver IC as a heat sink. Furthermore, a print wiring substrate on which a peripheral circuit is mounted is provided for driving the driver IC. It is necessary to prevent ink or ink mist leaked or scattered from a boundary surface between components, such as the head body, a mask plate, and the cover, from adhering to the print wiring substrate. Thus, penetration of ink is prevented by performing sealing by pouring a sealing material, such as adhesive, into gaps at the boundary surface between the components.

However, since there are large boundary surfaces between the components dictated by the complex shape of each component, when connecting a pipe of an ink circulation system to an ink tube of the ink jet head, ink may be spilled from the pipe. The spilled ink enters an inside of the cover and adheres to the print wiring substrate.

DETAILED DESCRIPTION

Figure 1:
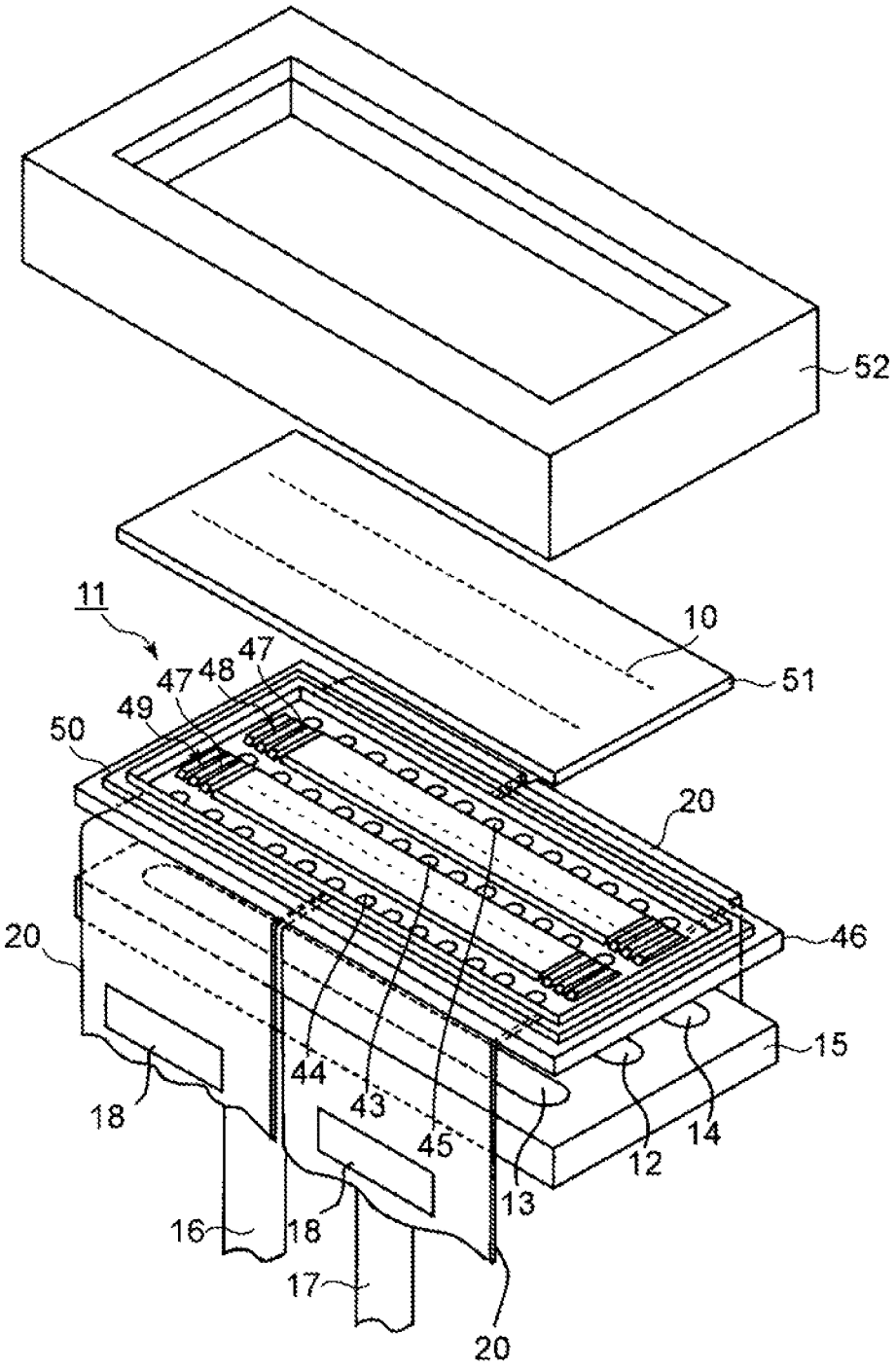
FIG. 1 is an exploded perspective view of an ink jet head according to one embodiment.

Embodiments provide an ink jet head and a printer in which ink is prevented from entering an inside of a cover and from adhering to a print wiring substrate.

In general, according to one embodiment, an ink jet head includes: a head body having a plurality of ejection ports for ink; a plurality of pipes disposed in a manifold, the manifold configured to supply ink to the head body and discharge ink in a longitudinal direction of an axis of the plurality of pipes intersecting the head body; a plurality of flexible substrates including flexible bodies bent in the longitudinal direction of the axis of the plurality of pipes and driving circuits for the head body, the plurality of flexible substrates being connected to a print wiring substrate; a reference plate disposed between the plurality of flexible substrates and including: a through port for each of the plurality of pipes, a sealing material disposed along an outer periphery of the respective pipe for each through port, and end portions disposed outside each through port in an arrangement direction of the plurality of pipes; a plate base including an upper surface against which the manifold and the head body are positioned with respect to the reference plate, and a through hole for each through port opened to the upper surface; a plurality of in-covers, each of the plurality of in-covers including inner surface having a first mating surface in contact with the plate base, and an outer surface having a second mating surface in contact with the driving circuits; and a plurality of side covers respective disposed alongside the plurality of in-covers, each of the plurality of side covers having an inner surface that is thermally coupled to a respective one of the plurality of in-covers, and has a third mating surface in contact with the second mating surface of a respective one of the plurality of in-covers, and an outer surface fastened to the print wiring substrate.

According to another embodiment, a printer includes: the ink jet head according to any one of the embodiments described herein; and an ink tank of the ink jet head.

Hereinafter, the ink jet head according to the embodiment will be described with reference to FIGS. 1 to 10. Moreover, the same reference numerals are given to the same portions in each view and duplicated description will be omitted.

One Embodiment

FIG. 1 is an exploded perspective view of the ink jet head according to one embodiment. The ink jet head according to the embodiment includes a head body 11 provided with a plurality of ejection ports 10 of ink, a manifold 15 having a supply path 12 of ink to the head body 11 and discharge paths 13 and 14 for ink, and connection pipes 16 and 17 (pipes) that are provided in the manifold 15 in a longitudinal direction of a cylinder that is arranged orthogonal to the head body 11 and respectively communicate with the supply path 12, and the discharge paths 13 and 14 of ink.

Figure 2:
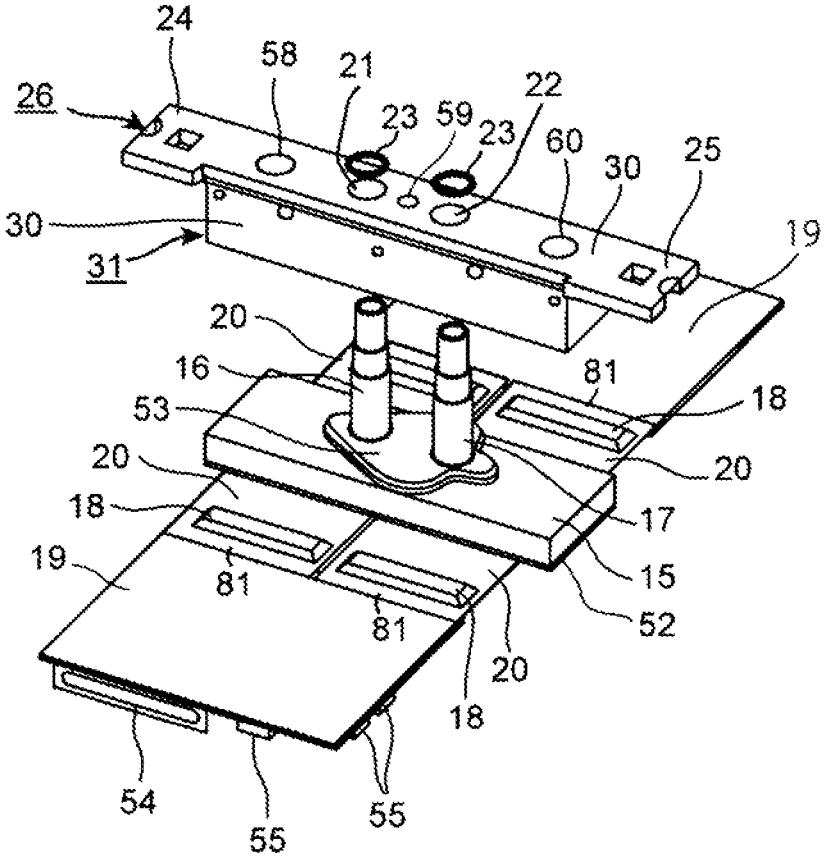
FIG. 2 is a partially exploded perspective view of the ink jet head according to one embodiment.

FIG. 2 is a partial exploded perspective view of the ink jet head according to one embodiment and illustrates the example in FIG. 1 by being upside down. Elements in FIG. 2 that are the same or similar to those described above are designated with identical reference numerals. Each ink jet head according to the embodiment includes four flexible substrates 20 each having a film (flexible body) that is bent from a development posture orthogonal to the longitudinal direction of the cylinder of the connection pipes 16 and 17 to a bending posture in the longitudinal direction of the cylinder. Each flexible substrate 20 includes a driver IC 18 (driving circuit) of the head body 11 on the film, and connection terminals 81 to a print wiring substrate 19. The ink jet head according to the embodiment further includes a reference plate (DATUM-PLATE) 26 that is provided between the flexible substrates 20. The reference plate 26 includes through ports 21 and 22 for each of the connection pipes 16 and 17, a sealing material 23 disposed along an outer periphery of the connection pipe for each of the through ports 21 and 22, and both end portions 24 and 25 that are positioned outside each of the through ports 21 and 22 in an arrangement direction of the connection pipes. The end portions 24 and 25 are fixed to a structure body on the printer body side.

Figure 3:
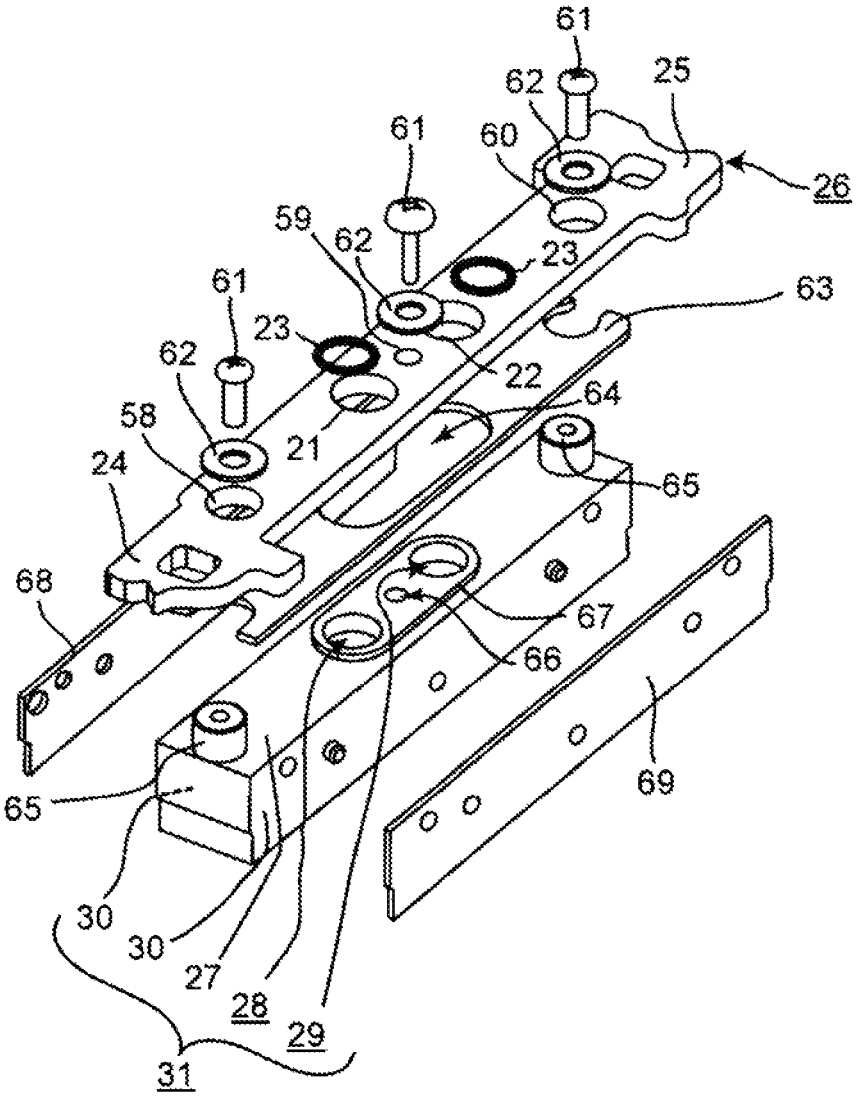
FIG. 3 is an exploded perspective view before the ink jet head according to one embodiment is fastened.

FIG. 3 is an exploded perspective view before the ink jet head according to one embodiment is fastened. The ink jet head according to the embodiment includes a plate base (DATUM-PLATE-BLOCK) 31 that has an upper surface 27 for positioning and fixing the head body 11 and the manifold 15 to the reference plate 26, through holes 28 and 29 for the through ports 21 and 22 opened to the upper surface 27, and a pair of flat side surfaces 30 coming into contact with the driver IC 18 by the bending posture of the flexible substrate 20.

Figure 4:
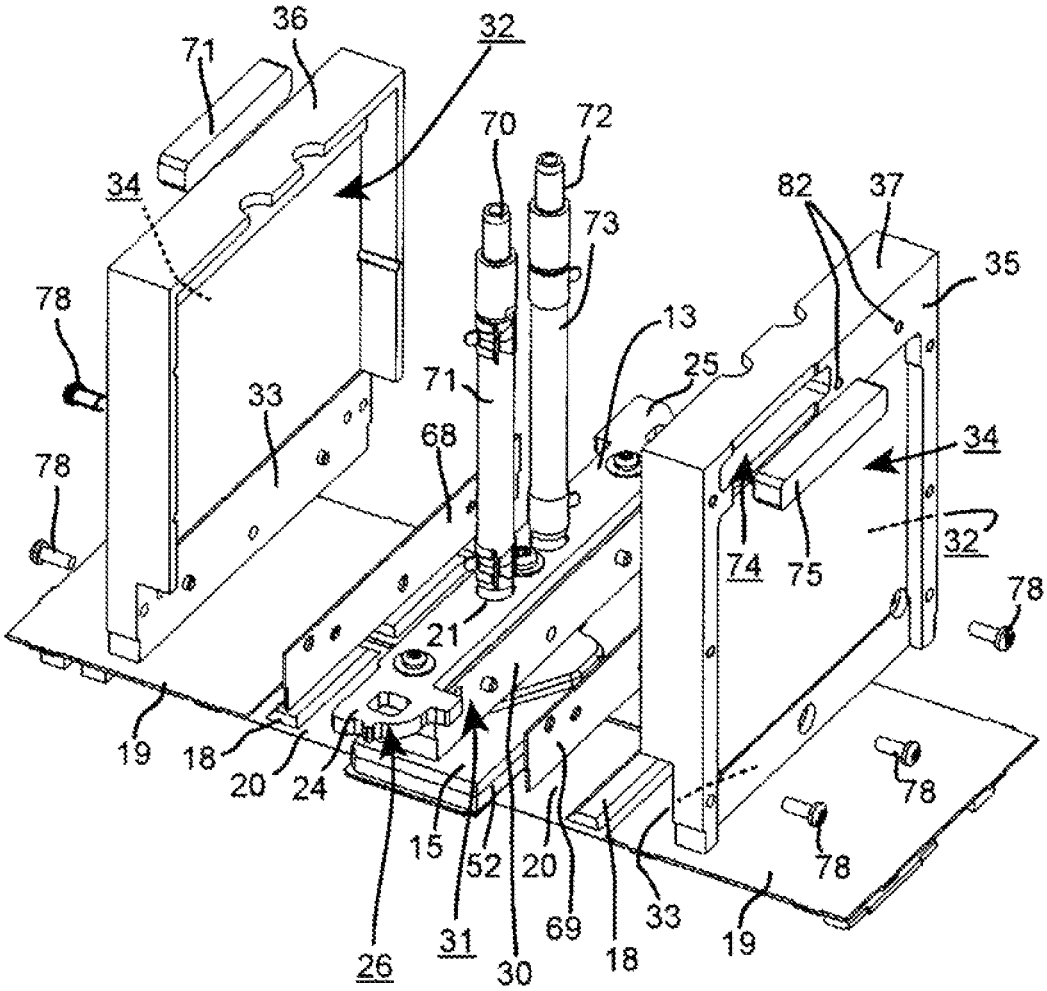
FIG. 4 is an exploded perspective view illustrating a reference plate, a plate base, and a plurality of in-covers of the ink jet head according to one embodiment as a body.
Figure 5:
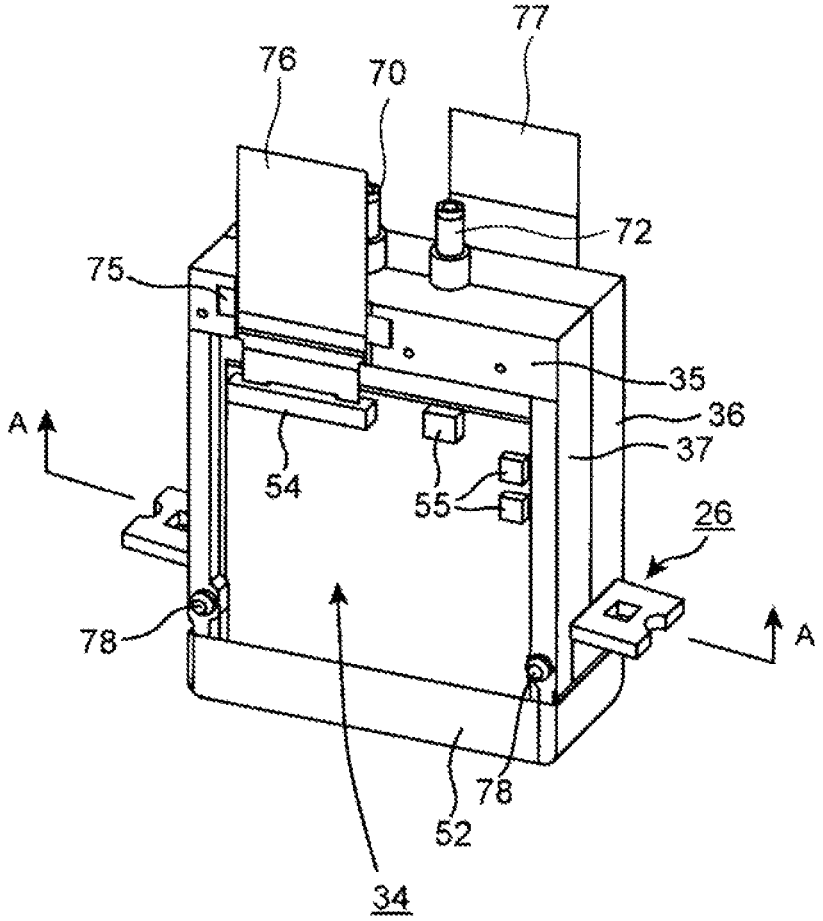
FIG. 5 is a perspective view of a state where side covers of the ink jet head according to one embodiment are removed.

FIG. 4 is an exploded perspective view illustrating the reference plate 26, the plate base 31, and in-covers 36 and 37 of the ink jet head according to one embodiment as a body. FIG. 5 is a perspective view of an assembly after the assembly in FIG. 4 is covered by the in-covers 36 and 37, and a perspective view illustrating a state where side covers 41 and 42 are removed from a finished product. Elements in FIG. 4 that are the same or similar to those described above are designated with identical reference numerals. The inkjet head includes two in-covers 36 and 37 that respectively have an inner surface 32 (see FIG. 4) covering the plate base 31, a first mating surface section 33 coming into contact with a side surface 30 of the plate base 31 formed on the inner surface 32 side thereof, an outer surface 34 on a side opposite to the inner surface 32, and a second mating surface section 35 formed on the outer surface 34 side thereof. The inner surface 32 is a surface facing the reference plate 26 and the plate base 31, and the outer surface 34 is a rear surface with respect to the inner surface 32. Furthermore, the driver IC 18 (driving circuit) is arranged on (in contact with) the outer surface 34 by the bending posture of the flexible substrate 20. The second mating surface section 35 includes an upper region on which screw receiving holes 82 of the in-cover 36 are formed and right and left regions that are continuous from the right and left of the upper region on the lower side. The second mating surface section 35 of the in-cover 37 is the same as the example of the in-cover 36.

Figure 6:
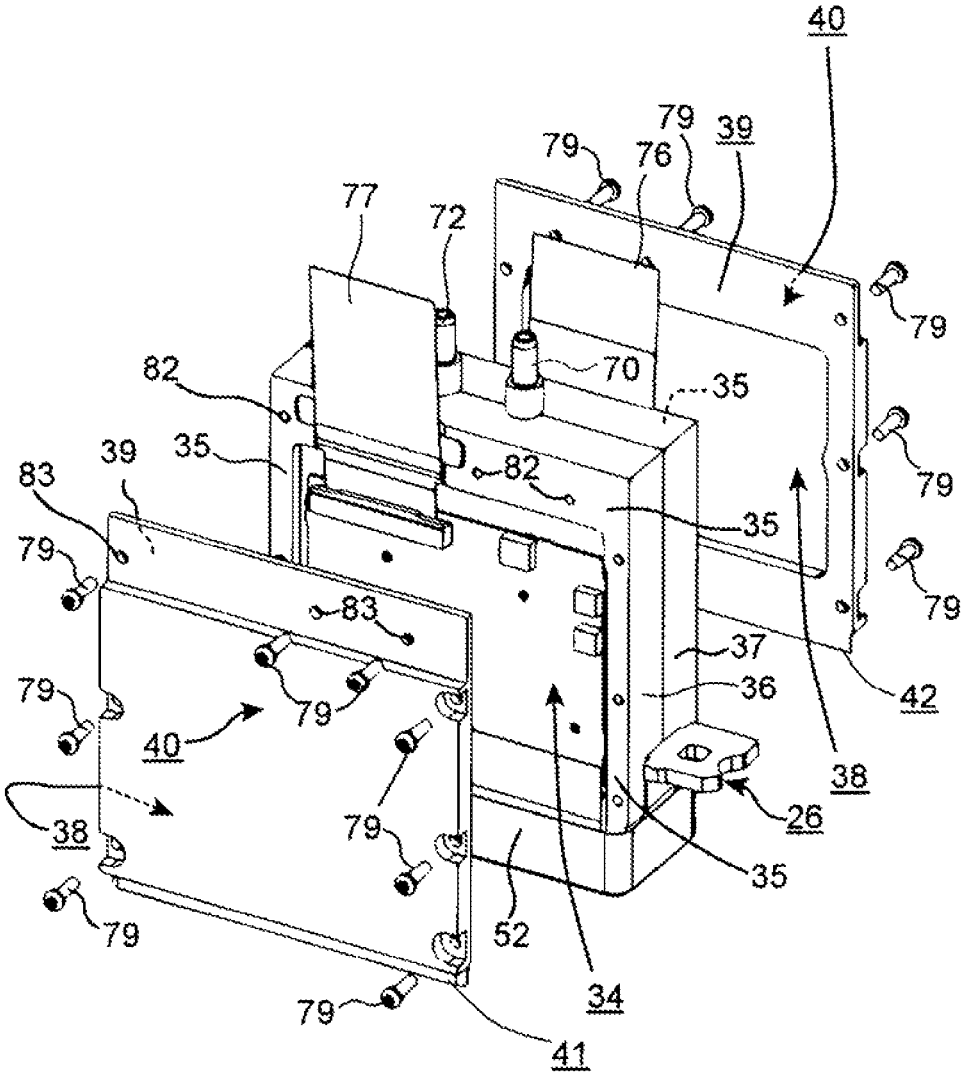
FIG. 6 is an exploded perspective view illustrating a positional relationship between the in-covers and the side covers of the ink jet head according to one embodiment.

FIG. 6 is an exploded perspective view illustrating a positional relationship between the in-covers 36 and 37 and the side covers 41 and 42 of the ink jet head according to one embodiment. Elements in FIG. 6 that are the same or similar to those described above are designated with identical reference numerals. Furthermore, the ink jet head according to the embodiment includes two side covers 41 and 42 respectively have an inner surface 38 that radiates heat with (is thermally coupled to) the in-covers 36 and 37 and faces the outer surface 34, a third mating surface section 39 that comes into surface contact with the second mating surface section 35 on the inner surface 38 side, and a surface section 40 that is fastened to the print wiring substrate 19. The inner surface 38 of the side cover 41 is a surface facing the in-cover 36, and the inner surface 38 of the side cover 42 is a surface facing the in-cover 37. The third mating surface section 39 is a surface region excluding a center of the side covers 41 and 42. The in-covers 36 and 37, and the side covers 41 and 42 are made of aluminum, and a volume of aluminum material is increased with respect to a cover material of the related art, which enhances heat radiation.

The head body 11 (FIG. 1) includes a base plate 46 having one column of ink supply holes 43 and two columns of ink discharge holes 44 and 45, piezoelectric bodies 48 and 49 on the base plate 46 having a plurality of grooves 47, a frame 50 surrounding the piezoelectric bodies 48 and 49, an orifice plate 51 having the plurality of ejection ports 10 arranged in an arrangement direction of nozzles, and a mask plate 52 covering an entirety of the head body 11. A conductive film for driving is formed in each groove 47 as an electrode. An edge portion on which the orifice plate 51 is mounted, and another edge portion of which a position is lower than that of the edge portion, are provided in an outer periphery of the frame 50. The mask plate 52 is mounted on the low edge portion.

The manifold 15 (FIG. 2) is a coupling section that also serves as a branch section of an ink flow path. The connection pipes (CONNECTION) 16 and 17 are connected to the manifold 15 through a member 53. The connection pipe 16 is a supply pipe communicating with the supply path 12 of ink and is connected to a tube 71. The connection pipe 17 is a discharge pipe communicating with the discharge paths 13 and 14 of ink and is connected to a tube 73

Each of the four flexible substrates 20 includes two sheets of heat-resistant flexible print wiring board (FPC) and, for example, include polyimide wiring film (Tape Carrier Package: TCP). The driver IC (Dr. IC) 18 is packaged in the flexible substrate 20 by a chip on film (COF). One end portion of each flexible substrate 20 is wired to the electrode within the head body 11. The other end portion of each flexible substrate 20 is connected to the rigid print wiring substrate 19. The print wiring substrate 19 is a peripheral circuit of the driver IC 18, electrically transmits and receives a control signal to and from the printer body, and is capable of individually driving the electrodes of the grooves 47. The print wiring substrate 19 may have a connector 54 to a controller 86 (FIG. 10) on the printer body, a passive component 55, and the like. In the example illustrated in FIG. 2, all four flexible substrates 20, which are shown in the development state, can be folded at an upper end portion of the base plate 46 and take the bending posture parallel to the longitudinal direction of the cylinder of the connection pipes 16 and 17.

Figure 10:
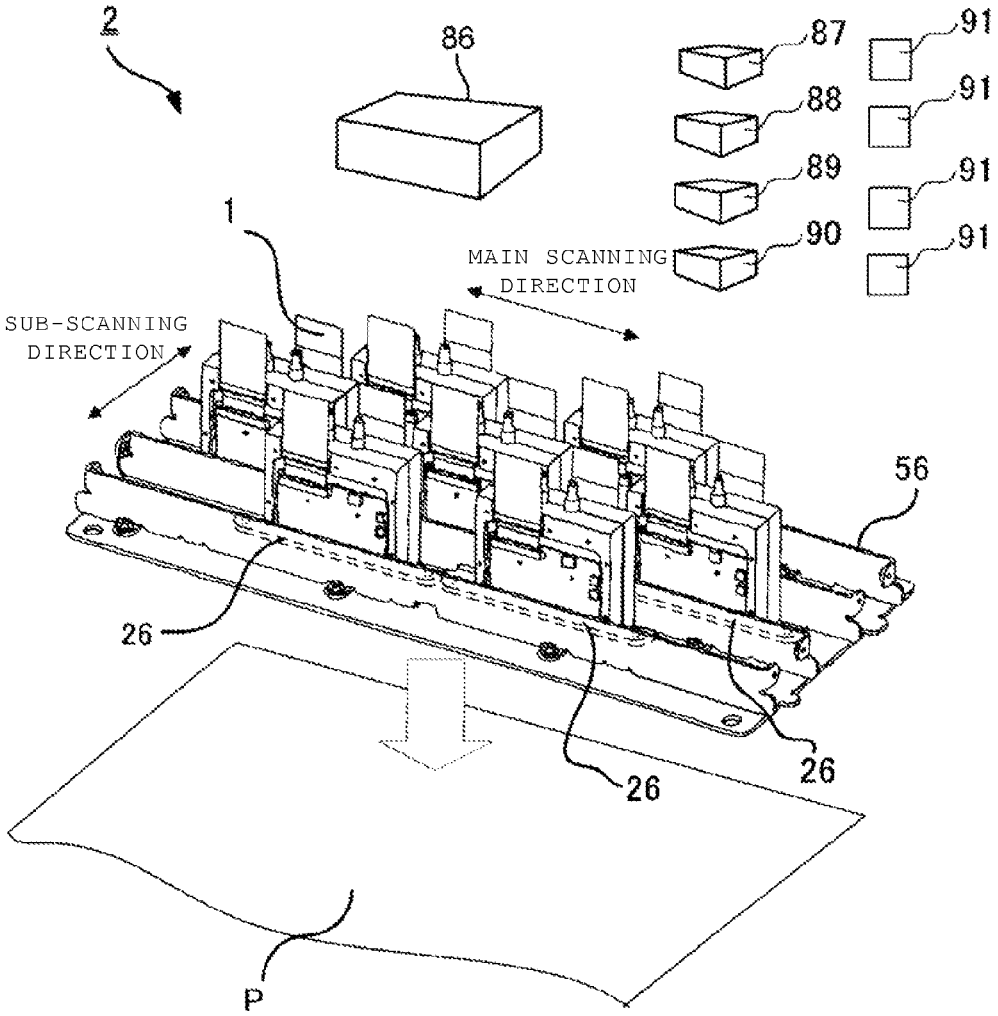
FIG. 10 is a partial perspective view of a printer according to one embodiment.

The reference plate 26 fixes the ink jet head according to the embodiment to a mounting plate 56 (structure body) on the printer body side, for example, as illustrated in FIG. 10 and positions the ink jet head with respect to the printer body. The reference plate 26 in FIG. 3 is configured such that both end portions 24 and 25 thereof are respectively fastened to the iron mounting plate 56 by bolts passing through bolts holes (shapes of both end portions 24 and 25 can vary). The reference plate 26 has strength of a degree not to be subject to deformation, such as deflection and bending, when the reference plate 26 is fastened. The reference plate 26 is formed by a material having a thermal expansion coefficient that is smaller than a thermal expansion coefficient of aluminum and, for example, stainless steel, steel, and the like. A portion between each inner wall of the through ports 21 and 22 and outer periphery surfaces of the connection pipes 16 and 17 is bonded and fixed by the sealing material 23, such as adhesive. Furthermore, the reference plate 26 is fastened to the plate base 31 between the both end portions 24 and 25 by screws 61 and washers 62 in through holes 58, 59, and 60. The reference plate 26 is fastened to the plate base 31 at a center portion in a longitudinal direction of the plate.

The ink jet head according to the embodiment may be fastened by interposing an elastic sheet 63, such as a gasket (DATUM-SHEET), between the reference plate 26 and the plate base 31. Other elastic sheets 68 and 69 may be provided on both right and left side surfaces of the plate base 31 as heat shielding members.

Figure 9:
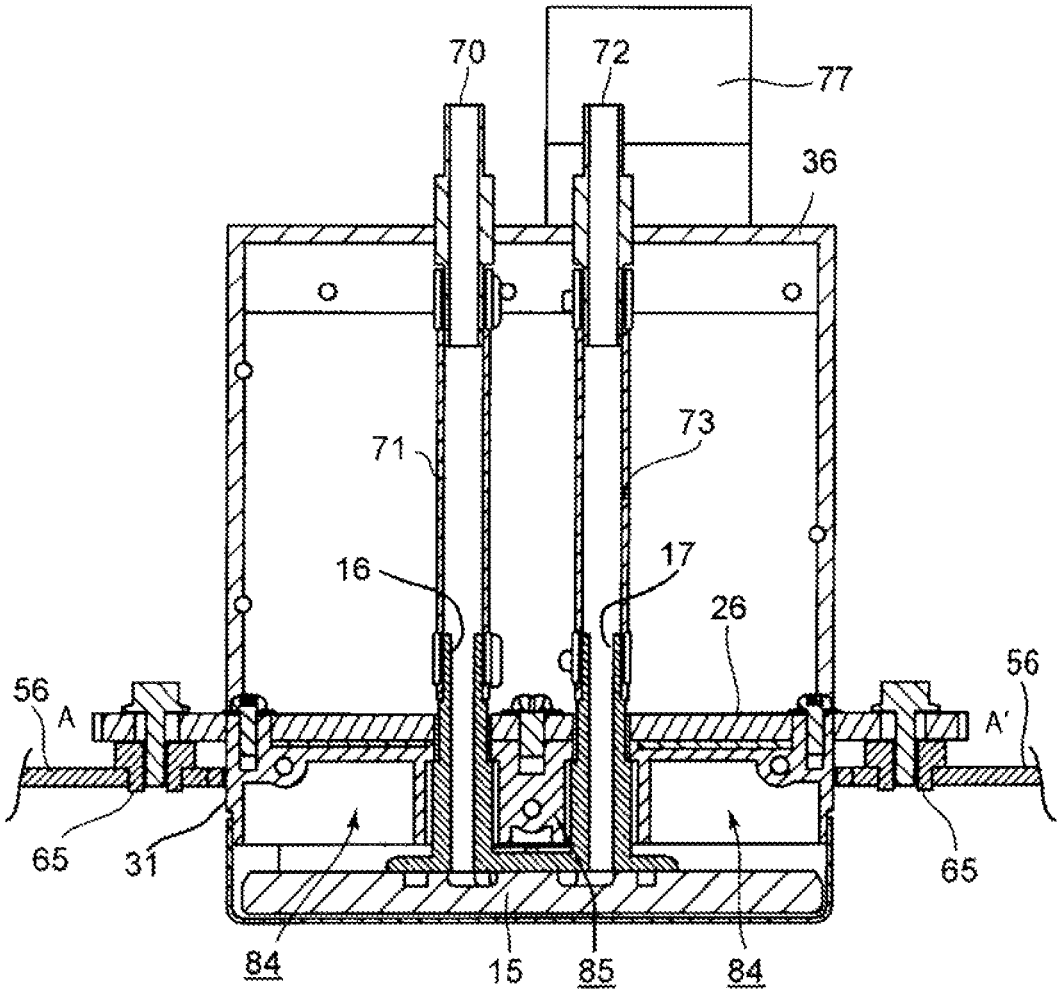
FIG. 9 is a vertical sectional view of the ink jet head according to one embodiment.

FIG. 9 is a vertical sectional view of the ink jet head according to the embodiment, which is taken along line AA' in FIG. 5. Elements in FIG. 9 that are the same or similar to those described above are designated with identical reference numerals. Both right and left ends of the reference plate 26 are fastened to the mounting plate 56 by bolts. As illustrated in FIGS. 3 and 9, the plate base 31 is a molded block that is formed by a material having a low thermal conductivity. For the plate base 31, a hollow plastic molded article is used to minimize heat transfer. In an example, the plate base 31 has thinned spaces 84 that are respectively provided on the right and left, and a screw receiving section 85 that is provided at a center portion between the thinned spaces 84. Furthermore, as illustrated in FIG. 3, studs 65 that also serve as spacers are erected on both sides in the longitudinal direction of the plate on the upper surface of the plate base 31. The studs 65 pass through the through holes 58 and 60 of the reference plate 26 and are locked by the screws 61 and the washers 62. Since the reference plate 26 is not fastened to the plate base 31 without being pressed down, an escape space against heating is provided in the reference plate 26. Prevention of exit of the reference plate 26 to the upper portion, prevention of deformation, and prevention of rotation of the reference plate 26 are achieved by preventing or minimizing thermal expansion of the reference plate 26. Furthermore, a spacer 67 is provided at a center portion in the longitudinal direction of the plate on the upper surface of the plate base 31, and the spacer 67 is provided with openings for a screw receiving hole 66 and the through holes 28 and 29. The screw 61 mates with the screw receiving hole 66 from above through the opening 64 of the elastic sheet 63.

Furthermore, the in-covers 36 and 37 in FIG. 4 are aluminum molded bodies and surround each of a supply pipe 70, the tube 71, a discharge pipe 72, and the tube 73 inside themselves by being closely fixed to each other. Each screw 78 mates with both right and left side surfaces 30 of the plate base 31, closely fixing the in-covers 36 and 37 to each other. The left in-cover 36 faces the plate base 31, and the first mating surface section 33 on a lower side on the inner surface 32 comes into surface contact with the side surface 30 of the plate base 31. The right in-cover 37 also has substantially the same shape as that of the in-cover 36. The in-covers 36 and 37 are fixed to each other, whereby the in-covers 36 and 37 prevent leakage of ink and scattering of ink, receive heating from the driver IC 18, and may radiate heat as the heat sink. A groove 74 passing through the in-covers 36 and 37 may be formed at an upper portion of each inner surface 32 of the in-covers 36 and 37. An elastic body (SEAL-RUBBER-FFC) 75 may be provided in the groove 74.

As illustrated in FIG. 5, a flat cable 76 is connected to an end portion on a side opposite to the flexible substrate 20 through the connector 54 in one print wiring substrate 19. The elastic body 75 is provided in the second mating surface section 35 of the in-cover 36 as a protective material for protecting the flat cable 76 from exposure to ink. Adhesive may be used in the protective material. The elastic body 75 is mounted at a height of a fitting portion between the flat cable 76 and the connector 54. The flat cable 76 is used for signal wiring to receive and transmit a signal from and to a controller 86 on the printer body side. A flat cable 77 is similar to the example of the flat cable 76.

Figure 7:
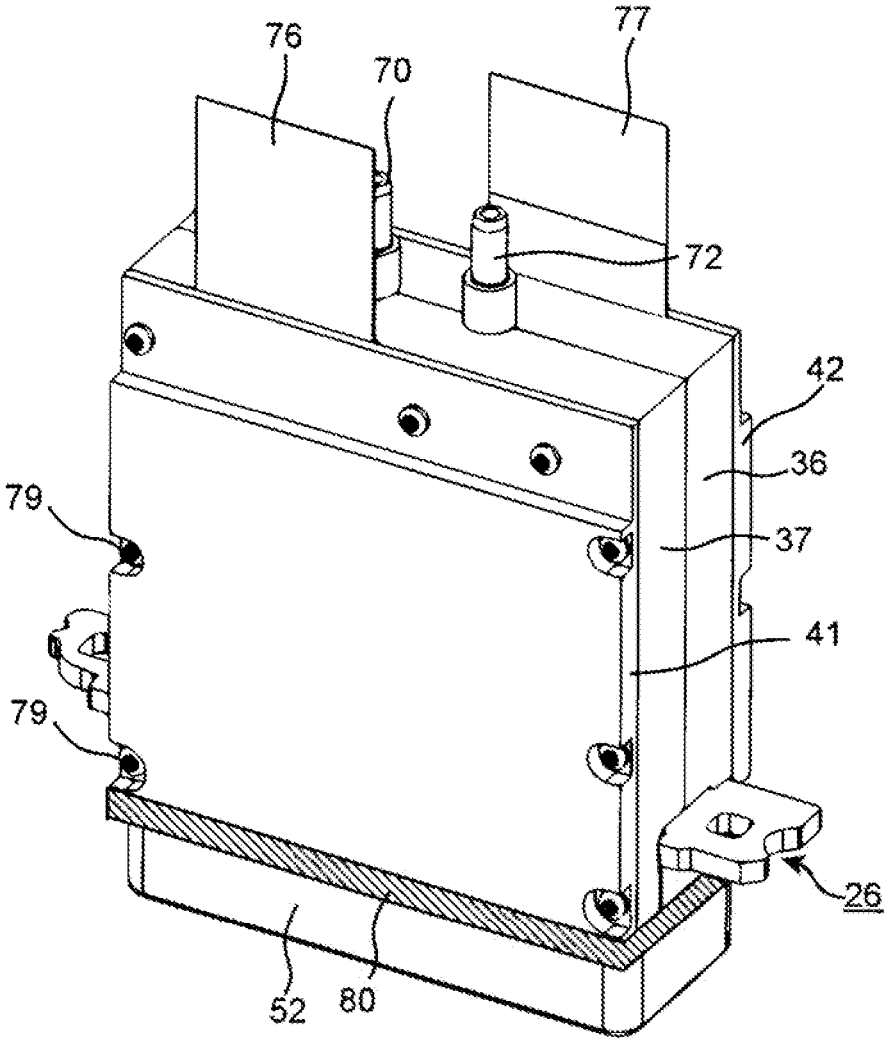
FIG. 7 is a perspective view after the ink jet head according to one embodiment is fastened.

FIG. 7 is a perspective view after the ink jet head according to one embodiment is fastened and illustrates an example after component elements in FIG. 6 are assembled. Elements in FIG. 7 that are the same or similar to those described above are designated with identical reference numerals. As illustrated in FIGS. 6 and 7, the third mating surface section 39 of the side cover 41 is a mating surface with the second mating surface section 35 of the in-cover 36, the second mating surface section 35 and the third mating surface section 39 are closely fixed to each other, whereby leakage of ink and scattering of ink from the inside to the outside of the in-covers 36 and 37 are prevented. The side cover 41 is closely fixed to the in-cover 36 by screwing each screw 79 into the corresponding screw receiving hole 82 of the in-cover 36 through the corresponding receiving hole 83 of the side cover 41. The inner surface 38 of the side cover 41 faces the print wiring substrate 19 erecting on the outer surface 34 of the in-cover 36. In a state where the flexible substrate 20 is bent and erected after the in-covers 36 and 37 come into close contact with each other, each of two driver ICs 18 on the right side comes into close contact with the lower portion of the outer surface 34 of the in-cover 37 and the radiation of heat is also performed on the outer surface 34 side. The side cover 41 performs heat exchange of the generated heat with outside air as the heat sink. The side cover 42 is the same as the example of the side cover 41.

In the ink jet head in FIG. 7, a sealing tape 80 is wound.

Figure 8A:
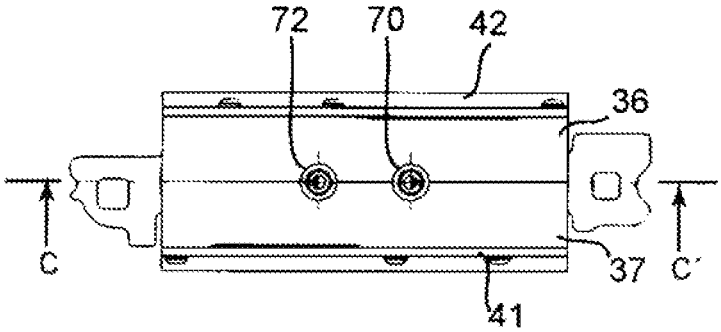
FIGS. 8A to 8C are three-plane views of the ink jet head according to one embodiment.
Figure 8B:
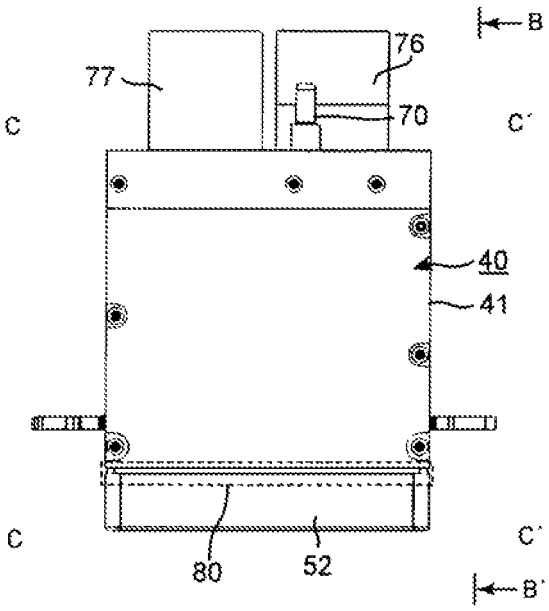
Figure 8C:
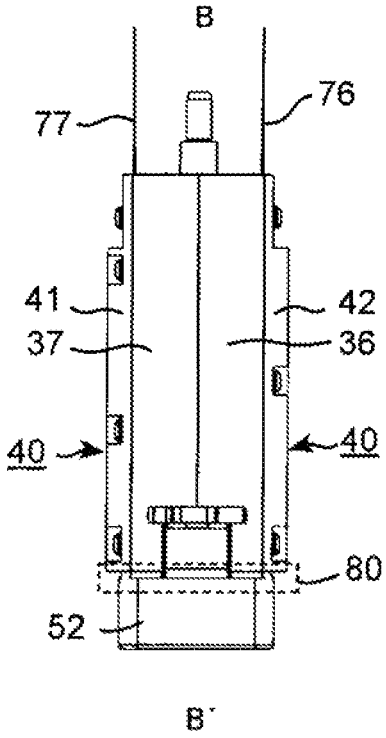

FIGS. 8A to 8C are three plane views of the ink jet head according to one embodiment. FIG. 8A is a top view of the ink jet head, FIG. 8B is a front view in FIG. 8A, and FIG. 8C is a right side view that is taken by line BB' in FIG. 8B. Elements in FIGS. 8A to 8C that are the same or similar to those described above are designated with identical reference numerals. As indicated by broken lines in FIGS. 8B and 8C, the sealing tape 80 is wound along each outer surface 34 of the in-covers 36 and 37 at the boundary surface between the in-covers 36 and 37, and the mask plate 52. The sealing tape 80 is tetrafluoride ethylene resin unfired tape (raw tape) for sealing (JIS K 6896) and is made of polytetrafluoroethylene (PTFE). Furthermore, the shield is reinforced by covering the sealing tape 80 with a heat-shrinkable film for falling prevention or a heat-shrinkable tube.

FIG. 10 is a partial perspective view of a printer illustrating a positional relationship when a plurality of ink jet heads according to the embodiment are arranged in the printer body. Elements in FIG. 10 that are the same or similar to those described above are designated with identical reference numerals. A printer 2 is a color printer and includes a plurality of ink jet heads 1 (ink jet head according to the embodiment), ink tanks 87, 88, 89, and 90 of four colors, and each of circulation pumps 91 for each of the ink tanks 87 to 90. Two or three ink jet heads which are respectively arranged in a main scanning direction are arranged in the printer 2 in a sub-scanning direction. The printer 2 is configured such that the ink jet heads 1 are provided to be arranged in zigzag with respect to a sheet P for each color in the mounting plate 56. The ink jet heads 1 are arranged such that head center lines of the ink jet heads 1 of a rear column (or front column) match an equally dividing position between head center lines of two ink jet heads 1 of the front column (or rear column).

Next, a method of operation of the ink jet head according to the embodiment having the configuration described above will be described. The ink jet head 1 is configured such that any driver IC 18 generates a pulse voltage signal by a driving signal from the printer body, an electric field is generated, and the side wall of the pressure chamber inside the head body is deformed. Ink is pressurized by expansion and contraction of the volume of the pressure chamber in the head body 11, and the head body 11 ejects liquid droplets from the ejection port 10. When the ink jet head 1 ejects the liquid droplets, heat generated by the driver IC 18 is received by the in-covers 36 and 37, and the side covers 41 and 42 radiate heat by heat exchange with the outside air.

The ink jet head according to the embodiment has a structure in which the boundary surface for applying sealant or the seal material such as adhesive is minimized to prevent entering of ink on the inside of the head body 11 while performing radiation of heat of the driver IC 18 for driving the head, whereby it is possible to reduce location where the sealing material such as adhesive flows into or is applied. The boundary surface that is the location where the sealing material is applied may have a shape by which a sealing process is easily automated. Since the mating surface section is in a range having a shape surrounded by a straight line, it becomes easy to fit movement of a manufacturing robot and automation advances.

Specifically, the sealing location is reduced and the surface mating portion having a linear shape may be formed by a structure of the following descriptions of (1) to (5).

(1) A top surface of each driver IC 18 faces the manifold 15 side on the flexible substrate 20. The sealing material 23 is bonded and fixed such that ink does not enter from the boundary surface in which the reference plate 26 comes into contact with cylindrical sections of the connection pipes 16 and 17.

(2) As illustrated in FIG. 4, the in-covers 36 and 37 are mounted by mating the cover edges thereof each other in the upper portion and the first mating surface sections 33 thereof being mated in the both side surfaces 30 of the plate base 31 in the lower portion. Since surface mating positions between the first mating surface section 33 and the side surface 30 are present in two locations, leakage of ink is prevented. Furthermore, elastic sheet 69 such as a gasket is inserted between the plate base 31 and the in-covers 36 and 37. Thus, effects of preventing ink from entering the inside of the cover and from adhering to the print wiring substrate 19 are enhanced.

(3) As illustrated in FIG. 5, in a state where the in-covers 36 and 37 are mounted, the flexible substrate 20 is bent and the driver IC 18 comes into contact with the in-covers 36 and 37. The flexible substrate 20, the print wiring substrate 19, and the flat cables 76 and 77 are respectively accommodated in the in-covers 36 and 37. Leakage of ink or scattering of ink is prevented by surface mating between the sealing material 23, the first mating surface section 33, and the side surface 30.

(4) As illustrated in FIG. 6, the side covers 41 and 42 are mounted such that each second mating surface section 35 on the outside of the in-covers 36 and 37 sufficiently comes into close contact with the corresponding third mating surface section 39 on the inside of the side covers 41 and 42 without a gap. Entering of ink inside the cover is prevented by removing the boundary surface by overlapping the flat surface and the flat surface. As illustrated in FIG. 4, since the elastic body 75 is mounted on the groove 74 on the surface of the in-covers 36 and 37 facing the flat cables 76 and 77, it is possible to seal the flat cable 77 by the in-cover 36, the side cover 41, and the elastic body 75 by mounting the side cover 41 on the in-cover 36. The flat cable 76 is similar to the example of the flat cable 77.

(5) The sealing tape 80 is wound on the boundary surface of the in-cover 36, the side cover 41, and the mask plate 52. As falling prevention of the sealing tape 80, sealing or the shield effect is enhanced by covering the sealing tape 80 with a heat shrinkable film or a heat shrinkable tube.

As described above, according to the ink jet head and the printer according to the embodiment, it is possible to prevent ink from entering the inside of the cover and from adhering to the print wiring substrate 19.

When mounting the ink jet head according to the embodiment on the printer body, ink does not enter the inside of the cover and ink does not adhere to the print wiring substrate 19 even when ink is spilled from the connection pipes 16 and 17 when connecting the ink tanks 87 to 90, the circulation pump 91, the connection pipes 16 and 17, and the ink jet head by the ink tube. It is possible to prevent ink from being adhered to the print wiring substrate 19 during initial installation or during maintenance. It is possible to reduce locations where the sealing material flows into the boundary surface portion between components by complex shapes of the components. A process of the sealing material flowing through is not necessary and automation of manufacturing is achieved. That is, it is possible to automate a portion of the manufacturing process of a product by the robot. Furthermore, in the ink jet head according to the embodiment, it is possible to stop leakage of ink while radiating heat generated inside the ink jet head without providing an enclosure. Furthermore, in the ink jet head according to the embodiment, it is possible to relieve component dimension precision in each portion between the side covers 41 and 42, the mating section between the side covers 41 and 42, and the reference plate 26, and the mating section between the plate base 31 and the side covers 41 and 42. Even when twisting or distortion occurs in mating between the components due to cooling after each component is expanded by driving heat, according to the ink jet head according to the embodiment, it is possible to reliably prevent the leakage of ink or scattering of ink. It is possible to automate a process of winding of the sealing tape 80 around the outer peripheral portions of the side covers 41 and 42 many times. In the ink jet head according to the embodiment, since a top cover for covering the connection pipe 16 and the connection pipe 17 is not mounted, it may be not required to consider precision of a component mating portion when using the top cover.

Furthermore, the ink jet head according to the embodiment has a structure in which each of the driver IC 18, the print wiring substrate 19, and the like are individually accommodated by the in-covers 36 and 37, in which the side covers 41 and 42 of aluminum material having good thermal conductivity, in which the ink jet head of the ink circulation type which has two columns of the pressure chamber, and in which the driver IC 18 for driving and the print wiring substrate 19 are connected to each column. Since the in-covers 36 and 37, and the side covers 41 and 42, may be manufactured by securing the big volume of the aluminum material, in the ink jet head according to the embodiment, it is possible to increase the surface area and the volume of the in-covers 36 and 37, and the side covers 41 and 42, and improve radiation of heat by the accommodation structure made of aluminum.

Furthermore, the mating surface between the in-cover 36 and the side cover 41 is a plane, and the mating surface between the in-cover 37 and the side cover 42 is a plane, and surface contact is provided therebetween. The mating surface between the plate base 31 and one in-cover 36 is a plane, the mating surface between the plate base 31 and the other in-cover 37 is a plane, and surface contact is provided therebetween. The inkjet head is fixed, the reference plate 26 for positioning and the cylindrical sections of the connection pipes 16 and 17 are bonded and fixed such that the ink does not enter from the boundary surface. It is possible to prevent ink from entering the inside of the head body 11 by providing the structure described above.

Furthermore, the structure is provided in which ink is prevented from entering the inside of the head body 11 by sealing only between the boundary surfaces of the in-covers 36 and 37, the side covers 41 and 42, and the mask plate 52, and by the surface contact regarding the side covers 41 and 42, the in-covers 36 and 37, and the plate base 31. Thus, it is possible to reduce sealing locations and greatly simplify manufacturing processes during manufacturing of the ink jet head.

Furthermore, even a case where a gap occurs in the mating surface between the in-covers 36 and 37, even when ink enters the manifold 15 side from above, sealing is performed between the reference plate 26 and the connection pipes 16 and 17 in the lower portion. Thus, ink does not enter into the electrode section and the electrical portions of the head body 11, and entering of ink that requires replacement of the head body 11 is prevented.

In addition, connection pipes are provided in longitudinal direction of the cylinder orthogonal to the head body 11, but may be intersecting the head body 11 with being inclined. The elastic sheet (DATUM-SHEET-UPPER) 63 and the elastic sheets 68 and 69 are provided for preventing ink from entering between the reference plate 26 and the plate base 31 illustrated in FIG. 3, whereby it is possible to improve the effect of prevention of leakage of ink. It is also possible to prevent entering of ink by the surface contact between the lower surface of the reference plate 26 and the upper surface 27 of the plate base 31 without inserting the elastic sheet 63. Fins may be formed in the in-covers 36 and 37, and the side covers 41 and 42.

The both side surfaces 30 of the plate base 31, the first mating surface section 33, the second mating surface section 35, and the third mating surface section 39 are flat, but may not be a flat surface. Shapes of the mating portions of a pair of mating surface are configured such that one surface may be shaped to conform with the other surface.

Although the elastic body 75 is provided in the groove 74, the elastic body 75 may be provided in accordance with the positions of the flat cables 76 and 77 without providing the groove 74.

The printer according to the embodiment may be a printer of a POS terminal that is used in point of sales (POS) cash register. For example, the printer may be connected to the POS terminal having a sale registering section, an accounting calculation section, and a drawer as a receipt printer. The printer according to the embodiment may be also used in a label printer or a bar code printer.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An ink jet head, comprising:

a head body having a plurality of ejection ports for ink;

a plurality of pipes disposed in a manifold, the manifold configured to supply ink to the head body and discharge ink in an axial direction of the plurality of pipes;

a plurality of flexible substrates including flexible bodies bent in the axial direction of the plurality of pipes and driving circuits for the head body, the plurality of flexible substrates being connected to a print wiring substrate;

a reference plate disposed between the plurality of flexible substrates and including: a through port for each of the plurality of pipes, a sealing material disposed along an outer periphery of the respective pipe for each through port, and end portions disposed outside each through port in an arrangement direction of the plurality of pipes;

a plate base including an upper surface against which the manifold and the head body are positioned with respect to the reference plate, and a through hole for each through port opened to the upper surface;

a plurality of in-covers, each of the in-covers including an inner surface having a first mating surface in contact with the plate base and an outer surface having a second mating surface in contact with the driving circuits; and a plurality of side covers respectively disposed alongside the plurality of in-covers, each of the plurality of side covers having an inner surface that is thermally coupled to a respective one of the plurality of in-covers and has a third mating surface in contact with the second mating surface of a respective one of the plurality of in-covers, and an outer surface fastened to the print wiring substrate.

2. The ink jet head according to claim 1, further comprising:

a mask plate covering the head body; and an unfired tape of tetrafluoride ethylene resin wound in a boundary surface between the plurality of in-covers and the mask plate along each first outer surface of the plurality of in-covers.

3. The ink jet head according to claim 1, wherein the print wiring substrate is connected to a flat cable on a side opposite to an end portion where the print wiring substrate is connected to the plurality of flexible substrates, and wherein each second mating surface of the plurality of in-covers has a protective material disposed thereon to protect the flat cable from exposure to ink.

4. The ink jet head according to claim 1, wherein the plate base includes a pair of side surfaces in contact with the driving circuits.

5. The ink jet head according to claim 1, wherein the third mating surface of each of the plurality of side covers is disposed around a periphery thereof.

6. The inkjet head according to claim 1, wherein the head body comprises:

a base plate having a plurality of piezoelectric bodies disposed thereon and a frame surrounding the piezoelectric bodies.

7. The ink jet head according to claim 6, wherein the head body further comprises:

an orifice plate, disposed on the frame, having the plurality of ejection ports.

8. The ink jet head according to claim 6, wherein the base plate includes a column of ink supply holes and a plurality of columns of ink discharge holes.

9. The inkjet head according to claim 6, wherein the piezoelectric bodies include a plurality of grooves, and a conductive film is disposed in each of the plurality of grooves.

10. The inkjet head according to claim 9, wherein the plurality of flexible substrates is wired to electrodes formed by the conductive film in the head body.

11. A printer, comprising:

an ink tank; and an ink jet head including a head body having a plurality of ejection ports for ink;

a plurality of pipes disposed in a manifold, the manifold configured to supply ink to the head body and discharge ink in an axial direction of the plurality of pipes;

a plurality of flexible substrates including flexible bodies bent in the axial direction of the plurality of pipes and driving circuits for the head body, the plurality of flexible substrates being connected to a print wiring substrate;

a reference plate disposed between the plurality of flexible substrates and including: a through port for each of the plurality of pipes, a sealing material disposed along an outer periphery of the respective pipe for each through port, and end portions disposed outside each through port in an arrangement direction of the plurality of pipes;

a plate base including an upper surface against which the manifold and the head body are positioned with respect to the reference plate, and a through hole for each through port opened to the upper surface;

a plurality of in-covers, each of the in-covers including an inner surface having a first mating surface in contact with the plate base and an outer surface having a second mating surface in contact with the driving circuits; and a plurality of side covers respectively disposed alongside the plurality of in-covers, each of the plurality of side covers having an inner surface that is thermally coupled to a respective one of the plurality of in-covers and has a third mating surface in contact with the second mating surface of a respective one of the plurality of in-covers, and an outer surface fastened to the print wiring substrate.

12. The printer according to claim 11, further comprising:

a mask plate covering the head body; and an unfired tape of tetrafluoride ethylene resin wound in a boundary surface between the plurality of in-covers and the mask plate along each first outer surface of the plurality of in-covers.

13. The printer according to claim 11, wherein the print wiring substrate is connected to a flat cable on a side opposite to an end portion where the print wiring substrate is connected to the plurality of flexible substrates, and wherein each second mating surface of the plurality of in-covers has a protective material disposed thereon to protect the flat cable from exposure to ink.

14. The printer according to claim 11, wherein the plate base includes a pair of side surfaces in contact with the driving circuits.

15. The printer according to claim 11, wherein the third mating surface of each of the plurality of side covers is disposed around a periphery thereof.

16. The printer according to claim 11, wherein the head body comprises:

a base plate having a plurality of piezoelectric bodies disposed thereon and a frame surrounding the piezoelectric bodies.

17. The printer according to claim 16, wherein the head body further comprises:

an orifice plate, disposed on the frame, having the plurality of ejection ports.

18. The printer according to claim 16, wherein the base plate includes a column of ink supply holes and a plurality of columns of ink discharge holes.

19. The printer according to claim 16, wherein the piezoelectric bodies include a plurality of grooves, and a conductive film is disposed in each of the plurality of grooves.

20. The printer according to claim 19, wherein the plurality of flexible substrates is wired to electrodes formed by the conductive film in the head body.

* * * * *